US009004443B2

(12) United States Patent
Zhang

(10) Patent No.: US 9,004,443 B2
(45) Date of Patent: Apr. 14, 2015

(54) EARLY-STRIPPING FORMWORK SYSTEM FOR CONCRETING OF CONSTRUCTIONS COMPRISING BEAMS, SLAB AND COLUMNS

(75) Inventor: Jianhua Zhang, Shandong (CN)

(73) Assignee: Shandong Prima Formwork Co., Ltd., Rizhao (CN)

( * ) Notice: Subject to any disclaimer, the term of this patent is extended or adjusted under 35 U.S.C. 154(b) by 0 days.

(21) Appl. No.: 14/233,080

(22) PCT Filed: Jul. 18, 2012

(86) PCT No.: PCT/CN2012/078786
§ 371 (c)(1),
(2), (4) Date: Apr. 1, 2014

(87) PCT Pub. No.: WO2013/139102
PCT Pub. Date: Sep. 26, 2013

(65) Prior Publication Data

US 2014/0263941 A1 Sep. 18, 2014

(30) Foreign Application Priority Data

Mar. 19, 2012 (CN) ..... 2012 1 0072390

(51) Int. Cl.
*E04G 11/56* (2006.01)
*E04G 11/00* (2006.01)
(Continued)

(52) U.S. Cl.
CPC ..... *E04G 11/00* (2013.01); *E04G 11/38* (2013.01);
(Continued)

(58) Field of Classification Search
CPC ..... E04G 11/36; E04G 11/38; E04G 11/48; E04G 11/483; E04G 11/486
USPC ..... 249/18, 26, 28; 108/156, 157.1, 157.17, 108/159
See application file for complete search history.

(56) References Cited

U.S. PATENT DOCUMENTS 3,647,173 A 3/1972 Pipala
3,784,151 A 1/1974 Steele

FOREIGN PATENT DOCUMENTS

CN 101498174 8/2009

(Continued)

OTHER PUBLICATIONS

International Searching Authority, "International Search Report," issued in connection with International application No. PCT/CN2012/078786, dated Dec. 20, 2012, 4 pages.

*Primary Examiner* — Michael Safavi
(74) *Attorney, Agent, or Firm* — Hanley, Flight & Zimmerman, LLC

(57) ABSTRACT

An early-stripping formwork system for concreting of constructions comprising beams, slab and columns comprises several rectangular standard formworks (1), props with multiple early-stripping support mechanisms (2), several filler beams (3) and filler panels. The standard formwork (1) consists of a panel (11) and a formwork frame (12), and the formwork frame (12) is provided with L-shaped corners (121) at its four corners. Each of the early-stripping prop (2) consists of an upper support inner tube (21) and a lower support tube (22) which form a telescopic connection, a rectangular head plate (23) is disposed at the top end of the upper support inner tube (21), one corner of the head plate (23) fits an internal corner of any one of the L-shaped corners (121) on the formwork frame (12). A load-releasing mechanism (24) is connected between the upper support inner tube (21) and the lower support outer tube (22). An early stripping mechanism (25) for early stripping of the standard formwork (1) is disposed on the upper support inner tube (21), short posts (251) for supporting the formwork frame (12) are disposed at four corners of the early stripping mechanism (25), and a structure for preventing the formwork frame (12) from slipping outwards is formed between the short post (251) and the L-shaped corner (121). The formwork frame (12), the filler panel, the filler beam (3), and a bridge beam (4) may be all in a detachable combined structure. In the formwork system, transport and storage of the formwork are convenient, and manufacturing cost is reduced.

15 Claims, 14 Drawing Sheets

(51) Int. Cl.

| | |
|---|---|
| ***E04G 11/38*** | (2006.01) |
| ***E04G 11/48*** | (2006.01) |
| ***E04G 11/06*** | (2006.01) |
| ***E04G 11/36*** | (2006.01) |
| ***E04G 17/00*** | (2006.01) |

(52) U.S. Cl.

CPC ..... *E04G 11/483* (2013.01); *E04G 11/486* (2013.01); *E04G 11/06* (2013.01); *E04G 11/36* (2013.01); *E04G 17/00* (2013.01)

(56) References Cited

FOREIGN PATENT DOCUMENTS

| | | |
|---|---|---|
| CN | 101591973 | 12/2009 |
| CN | 201416268 | 3/2010 |
| CN | 201605803 | 10/2010 |
| CN | 201943344 | 8/2011 |
| FR | 2136813 | 12/1972 |
| GB | 1102423 | 2/1968 |
| JP | 8158643 | 6/1996 |

EARLY-STRIPPING FORMWORK SYSTEM FOR CONCRETING OF CONSTRUCTIONS COMPRISING BEAMS, SLAB AND COLUMNS

FIELD OF THE INVENTION

The invention relates to a formwork and a scaffold of construction equipment, and particularly relates to an early-stripping formwork system for concreting of constructions comprising beams, slab and columns.

BACKGROUND OF THE INVENTION

It is an objective for which owners and construction units have been striven to bring forward or shorten the construction period. For this purpose, it is undoubtedly a solution to equip with a large amount of formworks and workers, for example, one identical construction site is equipped with a plurality of sets of formworks, which however, will increase the construction cost greatly. Thus an early-stripping formwork set-forming technology only needing one set of formwork as well as several sets of props becomes the best solution recognized by persons of the same occupation at home and abroad. Existing foreign systems have too high costs and are inappropriate to the domestic building structures. Even if a system that is very popular in foreign countries, such as Germany PERI which has a system comprising props, beams, slab and many auxiliaries due to the characteristics of its structure design, this system has certain limitations in construction efficiency besides non-adaptation to domestic floor building including building beams and complex structure of slab. Although there are many early stripping mechanisms with very good design principle in the domestic, they are not architectonical. A large amount of professional and technical personnel are still needed in the using process to conduct detailed and specific designs according to structures of different floors and different construction conditions, therefore it is very difficult to actually promote and popularize such early stripping mechanisms. In a Chinese patent publication CN101591973A which was published on Dec. 2, 2009 and is titled as "An Early-stripping Formwork System for Construction of Floors Comprising Beams, Slab and Columns", it discloses an early-stripping formwork system comprising early-stripping props, early stripping mechanisms, a load-releasing mechanism, formworks, filler panels, filler beams, secondary filler beams and secondary filler panels, wherein the formworks are rectangular or square standard formworks in certain specifications. Through particular design and comprehensive adjustment of structure, the difficulty of using an early-stripping system in horizontal formworks of construction of building floors comprising beams, slab and constructional columns, or the difficulty of no obvious advantages even if traditional early stripping is applied is solved. The horizontal formwork of the overall early-stripping system comprises very small number of basic parts: props comprising early stripping mechanisms, square or rectangular main formworks, filler beams, secondary filler beams and secondary filler panels. A toy bricks system is applied so that the overall system is simple and convenient to operate and use, is safe and reliable, efficient, time-saving and energy-saving. However, the frame of the formwork is in welded rigid construction, which causes shortages of large storage and occupation space, inconvenience of transportation and storage, and high cost. In addition, both of the filler panels and the secondary filler panels are in the same structure of the formwork, need to be manufactured into many specifications, and cause shortages of inconvenience of transportation and storage and high cost, as well as increase of manufacturing cost.

SUMMARY OF THE INVENTION

The invention is aimed to provide an early-stripping formwork system for construction comprising beams, slab and columns which has low transportation and storage cost and is convenient to use, overcome the short comings of the past existing early-stripping formwork system of construction of floors comprising beams, slab and columns To achieve the above objective, the invention adopts the following technical solutions:

An early-stripping formwork system for concreting of constructions comprising beams, slab and columns, comprising several standard formworks, props with multiple early-stripping support mechanisms, several filler beams mainly used for supporting construction beams of floors, and filler panels; the standard formwork consists of a panel and a formwork frame and is in right-angle quadrilateral shape, and the formwork frame of the standard formwork is provided with L-shaped corners at its four corners; the early-stripping prop consists of an upper support inner tube and a lower support outer tube which forms a telescopic connection, a rectangular head plate is disposed at the top end of the upper support inner tube, and one corner of the head plate is complementary to an internal corner of any one of the L-shaped corners on the formwork frame; a load-releasing mechanism which causes the upper support inner tube to descend by a predetermined height is connected between the upper support inner tube and the lower support outer tube; an early stripping mechanism for early stripping of the standard formwork is disposed on the upper support inner tube, short posts for supporting the formwork frame are disposed at four corners of the early stripping mechanism, and a structure for preventing the formwork frame from slipping outwards is formed between the short post and the L-shaped corner; the formwork frame is in a detachable combined structure.

The early stripping mechanism, the load-releasing mechanism and the rectangular head plate are in correspondingly the same structure with the early stripping mechanism, the load-releasing mechanism and the rectangular head plate in the patent publication CN101591973A respectively.

In the invention adopting the preceding technical solution, due to the adoption of the detachable combined structure, the formwork frame can be detached into parts and components before being stored and transported for the convenience of storage and transportation, which can efficiently save space of storage and transportation and reduce warehouse capacity and transport capacity, thereby reducing cost of storage and transportation and being convenient to use.

In the preferred technical solution, the L-shaped corners of the formwork frame are fixedly connected with frame border beams by bolts, the four frame border beams form the rim of the formwork frame, a plurality of stiffening beams are disposed between a set of two opposing frame border beams therein, and the stiffening beams are fixedly connected to the frame boarder beams by bolts at both ends thereof; the L-shaped corners, the frame border beams and the stiffening beams each have a plane for supporting the panel. The formwork frame can be detached into the L-shaped corners, the frame border beams, the stiffening beams and the fastening bolts before being stored and transported, to ensure convenient transportation and save space of storage and transportation. The frame border beams adopt length combination in different or the same specification, so as to form rectangular or square formwork frame to meet different requirements.

In a further preferred technical solution, the L-shaped corner is in an integral structure; the frame border beam is formed by bending of a sheet material, the main structure of the frame border beam is in the shape of an inequilateral angle iron, the length of a vertical side of the angle iron of the frame border beam is larger than that of a horizontal side thereof, the frame border beam is connected to the L-shaped corner by the vertical side thereof, and stiffening structures are fixedly connected at connection locations on the frame border beam where the frame border beam is connected with the L-shaped corner; that the stiffening beam is formed by bending of a sheet material, the main structure of the stiffening beam is in the shape of a channel steel, the channel opening of the stiffening beam is provided in horizontal direction, connection blocks are fixedly connected at both ends of the stiffening beam, and the stiffening beam is connected to the frame border beam by the connection blocks; and that the frame border beam and the stiffening beam are all provided with lightening holes for lightening weight thereof. Under the premise of ensuring that the standard formworks have sufficient supporting strength, it is possible to reduce the thickness of the plates, to reduce resource consumption and reduce labor intensity of combining the formworks, so as to correspondingly improve production efficiency and reduce using cost.

In a further preferred technical solution, the L-shaped corner comprises a top angle iron and a bottom angle iron which are provided vertically and are in opposite internal angle directions, the top angle iron and the bottom angle iron are connected by a support plate which is provided horizontally and is supportable on an upper end face of any one of the short posts of the early-stripping mechanism, and the bottom angle iron and the short post form a structure for preventing the formwork frame from slipping outwards; and that support angle irons extend horizontally on two angle iron sides of the top angle iron, a horizontal side of the support angle iron is located at an upper part of the top angle iron, an upper plane of the horizontal side of the support angle iron is used for supporting the panel of the standard formwork, the distance between the upper plane of the horizontal side of the support angel steel and an upper end face of the top angle iron is equal to the thickness of the panel, and a vertical side of the support angle iron is provided with frame border beams connection holes for connecting the support angle iron with the frame border beams; the two angle iron sides of the top angle iron are provided with head plate connection holes for connecting the top angle iron with the head plate, auxiliary support holes are provided on the two angle iron sides of the bottom angle iron and are used as temporal supports which support the standard formwork on the short posts of the early stripping mechanism in early stripping or installation of the standard formwork; four uniformly distributed engaging lugs further project downwards on a lower end face of the head plate, and the engaging lugs are provided with through holes that fit head plate connection holes on any one of the angle iron sides of the top angle iron; the stiffening structure of the frame border beam is protruding pads which are welded with the frame border beam, the frame border beam is provided with connection through holes through which the frame border beam is in fixed connection with the L-shaped corner by bolts, and the connection through holes penetrate through the protruding pads; a lower end of the vertical side of the angle iron of the frame border beam is bent towards the direction of the internal angle of the inequilateral angle iron thereof to form channel steel shaped stiffening structure, and the lightening holes provided on the frame border beams are a plurality of frame border beam lightening holes positioned in the middle part of the vertical side of the angle iron; the upper end face of the horizontal side of the angle iron of the frame border beam is used for supporting the panel of the standard formwork, a turnup for positioning the panel extends upwards from the outer edge of the horizontal side of the angle iron of the frame border beam, the distance from an upper end face of the turnup to the upper end face of the horizontal side of the angle iron of the frame border beam is equal to the thickness of the panel; an outer end face of a side plate of the channel shape of the stiffening beam is used for supporting the panel, two connection blocks are provided at each end of the stiffening beams, are fixedly by welding respectively, and are provided with threaded holes through which the stiffening beam is fixedly connected to the corresponding frame border beam by bolts; the lightening holes provided on the stiffening beams are a plurality of weight lightening holes that are positioned on a base plate of the channel shape thereof. Overall rigidity and load carrying capacity of the formwork frame are further ensured. The connection holes may be unthreaded holes or threaded holes. When unthreaded holes are adopted, they are used by incorporating nuts; and when threaded holes are adopted, they are fixedly connected directly by bolts.

In another further preferred technical solution, the connection through holes of the frame border beam are threaded holes, and a stiffening ring is formed integrally by punching at the periphery of the frame border beam lightening holes on the frame border beam; turnups are provided at the tips of the two side plates of the channel shape of the stiffening beams, the tips of the two turnups are provided in opposite directions, stiffening rings protrude integrally at the periphery of the weight lightening holes of the stiffening beam, and the stiffening rigns are located within U-shaped part of the stiffening beam. Overall rigidity and load carrying capacity of the formwork frame are further ensured.

In a preferred technical solution, the filler beam consists of a filler beam body, a left corner and a right corner, wherein the left corner and the right corner are fixedly connected at both ends of the filler beam body respectively by bolts and are in left-and-right symmetrical structure, the filler beams can be supported on the corresponding short posts of the corresponding early stripping mechanisms respectively by the left corner and the right corner, and a structure for preventing the filler beams from slipping outwards is formed respectively between the short posts and the left corner and between the short posts and the right corner; an upper plane of the filler beam body and an upper plane of the head plate are in one identical horizontal plane; both of the left corner and the right corner are provided with a corner structure including internal corners, and the internal corners of the left corner and the right corner are complementary to a corresponding corner of the head plate. As the filler beam body, the left corner and the right corner are connected by bolts to form a detachable connection structure, the formwork frame can be detached into parts and components before being stored and transported for the convenience of storage and transportation, which can efficiently save space of storage and transportation and reduce warehouse capacity and transport capacity, thereby reducing cost of storage and transportation and being convenient to use.

In a further preferred technical solution, each of the left corner and the right corner is in integral structure; the filler beam body is formed by bending of a sheet material, the main structure of the filler beam body is in the shape of an inequilateral angle iron, the length of a vertical side of the angle iron of the filler beam body is larger than that of a horizontal side thereof, a stiffening backing plate is welded at connection locations of the filler beam body where the left corner and the right corner are connected with the right corner, connection via holes are provided on the connection locations of the filler beam body and penetrate through the stiffening backing plate, and several lightening holes for lightening the weight of the filler beam body are provided at the middle part of the vertical side of the inequilateral angle iron of the filler beam body. The filler beams are generally used for stiffening structural parts of beams of floors, and therefore they have a high requirement on bending strength. After the left corner and the right corner are formed in an integral structure, and the filler beam body is formed by bending of a sheet material, under the premise of ensuring the filler beam has sufficient supporting strength, it is possible to reduce thickness of the plates, reduce resource consumption and reduce labor intensity of combining the formworks, so as to correspondingly improve production efficiency and reduce using cost.

In a further preferred technical solution, the left corner comprises an upper angle iron and a lower angle iron which are provided vertically and are in opposite internal angle directions, the upper angle iron and the lower angle iron are connected by a connection plate which is provided horizontally and is supportable on an upper end face of one of the short posts of the early-stripping mechanism, and the lower angle iron and the short post form a structure for preventing the filler beams from slipping outwards; two angle iron sides of the upper angle iron are respectively provided with one, two or three punch holes which can be used for connection between the filler beam and the standard formwork, the punch holes also can be used in connection between two filler beams provided in opposite directions and in connection among two filler beams provided in opposite directions and the standard formwork, and the connection way to be selected is determined depending on specific conditions of providing the formwork system; a connection angle iron in horizontal shape protrudes out on one angle iron side of the upper angle iron, a horizontal side of the connection angle iron is located at an upper part of the upper angle iron, an upper plane of the horizontal side of the connection angle iron is used for supporting the filler beam body, and a vertical side of the connection angle iron is provided with filler beam body connection holes for connecting the connection angle iron with the filler beam body; the connection plate also extends towards the direction of the filler beam body and is used for supporting corresponding ends of the filler beam body; temporary support holes are provided on two angle iron sides of the lower angle iron and are used as temporal supports which support the filler beam on the short posts of the early stripping mechanism in detaching or installation of the filler beam; the filler beam body is fixedly connected to the left corner and the right corner by connection via holes provided at both ends of the vertical side of the inequilateral angle iron thereof, the lower end of the vertical side of the inequilateral angle iron of the filler beam body is further bent inwards to form a channel steel shaped stiffening structure having a trapezoidal cross section, the upper end face of the horizontal side of the inequilateral angle iron of the filler beam body and the upper end faces of the upper angle irons of the left corner and the right corner are in one identical horizontal plane, a turnup going downwards is provided at a tip of the horizontal side of the inequilateral angle iron of the filler beam body, and connection angle irons on the left corner and the right corner are wrapped within the turnup on the horizontal side of the filler beam body. Overall rigidity and load carrying capacity of the formwork frame are further ensured.

In a further preferred technical solution, the connection via holes of the filler beam body are threaded holes, and a stiffening ring is integrally formed at one side of the filler beam body along with the lightening holes. Overall rigidity and load carrying capacity of the formwork frame are further ensured.

In a preferred technical solution, the filler panel consists of two filler beams that are parallel and are provided in opposite directions, a bridge beam and a filler panel, wherein a hanging structure is provided between the filler beam and the bridge beam, and the bridge beam is hung on the filler beam by the hanging structure; the filler panel is fixedly connected on the bridge beam. The filler panel is mainly used in corner areas of the floors where the standard formwork can not be laid, as a supplement to the standard formwork, at that time, the upper plane of the filler panel and the upper plane of the standard formwork in an adjacent area are in one identical horizontal plane. The filler panel is further used in building base plates comprising construction columns, and space between two adjacent bridge beams is used for avoiding the construction columns. It is best to design the bridge beams into telescopic structure with length being adjustable, to facilitate implementation of width adjustment of the filler panel, certainly the size of the filler panel should adapt to an area formed by the filler beam and the bridge beam. Like the standard panel, the filler panel can also be used in floors of buildings having height difference, at that time, the upper support inner tube should further provides with a second early stripping mechanism for the early stripping thereof. Due to adoption of the filler panel in the preceding structure, the filler panel does not required to be provided in multiple specifications, and no components such as secondary filler beams or second filler panels and the like are required to be provided any more, so that using cost can be reduced greatly, in addition, the filler panel can be detached into parts and components before being stored and transported or the convenience of storage and transportation, which can efficiently save space of storage and transportation and reduce warehouse capacity and transport capacity, thereby reducing cost of storage and transportation and being convenient to use.

In a further preferred technical solution, the hanging structure comprises a Z-shaped hanging strip which is fixedly connected at the outer side of the vertical side of the inequilateral angle iron of the filler beam body in a fixed connection way such as threaded connection, riveting connection or welding connection or the like by means of one side of the hanging strip, and the other side of the Z-shape of the hanging strip and the vertical side of the inequilateral angle iron of the filler beam body form a hanging slot with an opening facing upwards; "7"-shaped hangers are fixedly connected at both ends of the bridge beam in the fixed connection way such as welding connection, riveting connection or threaded connection or the like, and the bridge beam is hung on two parallel filler beams by the hangers and the hanging slot. Convenient assembling and disassembling of the filler panel can be ensured.

In a further preferred technical solution, the main body of the bridge beam is bent into channel steel shape using a sheet material, the channel opening of the bridge beam faces upwards, and a wood is fixedly connected at the channel opening of the bridge beam by bolts; the filler panel is fixedly connected to the wood by screws. Under the premise of ensuring that the filler panels have sufficient supporting strength, it is possible to reduce thickness of the plates, to reduce resource consumption and reduce labor intensity of combining the filler panels, so as to correspondingly improve production efficiency and reduce using cost.

In a further preferred technical solution, the bridge beam consists of a first bridge beam and a second bridge beam which are provided in a lateral and staggered manner, slide guide rail pairs that fit with each other are provided on opposing side faces of the first bridge beam and the second bridge beam, and the first bridge beam and the second bridge beam create the axial telescope of the bridge beam by the slide guide rail pairs; the hangers are provided respectively on distal end faces of the first bridge beam and the second bridge beam. Under the condition of meeting the requirement of adjustable length of the bridge beam, the slide guide rail pairs are adopted to ensure that the first bridge beam and the second bridge beam have sufficient connection intensity and bending strength.

In a further preferred technical solution, the slide guide rail pairs consist of a guide rail and a sliding chute which are separately provided in pair; the cross section of the guide rail is T-shaped, the cross section of the sliding chute fits with that of the guide rail, and the guide rail is fixedly connected on one side wall of the first bridge beam or the second bridge beam in a connection way such as threaded connection, riveting connection or welding connection or the like; the sliding chute is formed by at least one set of two oppositely provided Z-shaped sectional materials of which two form one set and a corresponding side wall of the second bridge beam or the first bridge beam, the Z-shaped sectional material is fixedly connected to the second bridge beam or the first bridge beam in a connection way such as threaded connection, riveting connection or welding connection or the like by one side thereof, and a space formed by the other sides of the two Z-shaped sectional materials and corresponding side walls forms the sliding chute. The guide rail and the Z-shaped section materials are simple in structure and convenient to purchase, and the Z-shaped sectional materials forming the sliding chute are combined in a manner of segments, therefore using of which reduces material consumption and thereby achieving the purpose of reducing manufacturing cost.

In a preferred technical solution, upper support inner tubes of at least four adjacent early-stripping props among the several early-stripping props are provided with second early stripping mechanisms which are used for supporting the standard formworks or the filler panel of floors in slab bottom with steps, the second early stripping mechanisms are provided with four short posts the same with that in the early stripping mechanism, the short posts are used for top-holding the standard formwork or the filler panel. This technical solution can be applied widely in concreting floors in slab bottom with steps.

In a preferred technical solution, the second early stripping mechanism comprises a threaded pipe provided with external thread, the second early stripping mechanism comprises a threaded pipe provided with external thread, the threaded pipe is movably sleeved at the periphery of a pipe pole provided on the upper support inner tube, and the threaded pipe is provided with a kidney-shaped slot throughout the wall of the pipe; the threaded pipe is in fitting with a nut by the thread, and a flange is fixedly connected at an upper end of the threaded pipe; the short posts are fixedly connected on the flange in a manner of being uniformly distributed; a pin shaft is laterally fixed on the pipe pole, both ends of the hinge pin are in slide fitting in the kidney-shaped slot of the threaded pipe, the hinge pin supports the nut by an upper generatrix thereof. When it is necessary to implement the early stripping by the second early stripping mechanisms, the nut is rotated, so that the flange and the short post thereon drop vertically, so as to achieve the early stripping of corresponding formworks, avoiding the deficiency that the early stripping mechanism in the patent publication CN101591973A applies a transverse impact on the early stripping support posts in the way of transversely beating detaching formworks and support plates to thus easily cause the early stripping support posts to bend and deform, so as to be beneficial for prolonging service life of the early stripping support posts. It is best to configure special wrenches on the nuts to facilitate the early stripping operation.

The invention has beneficial effects that, the standard formworks, the filler panels, the filler beams and the bridge beams all can be provided in detachable combined structure, which is convenient for transportation and storage, can efficiently reduce capacity and transport capacity and be convenient to reduce the cost; meanwhile, the secondary filler beams and the second filler panels are not required to be provided any more, so that the specification and quantity of the formworks are reduced and it is beneficial for materials management and reducing using cost.

DETAILED DESCRIPTION OF THE EMBODIMENTS

Hereinafter, the invention will be described in detail incorporating accompanying drawings, but the invention is not limited within the scope of the embodiments.

Figure 1:
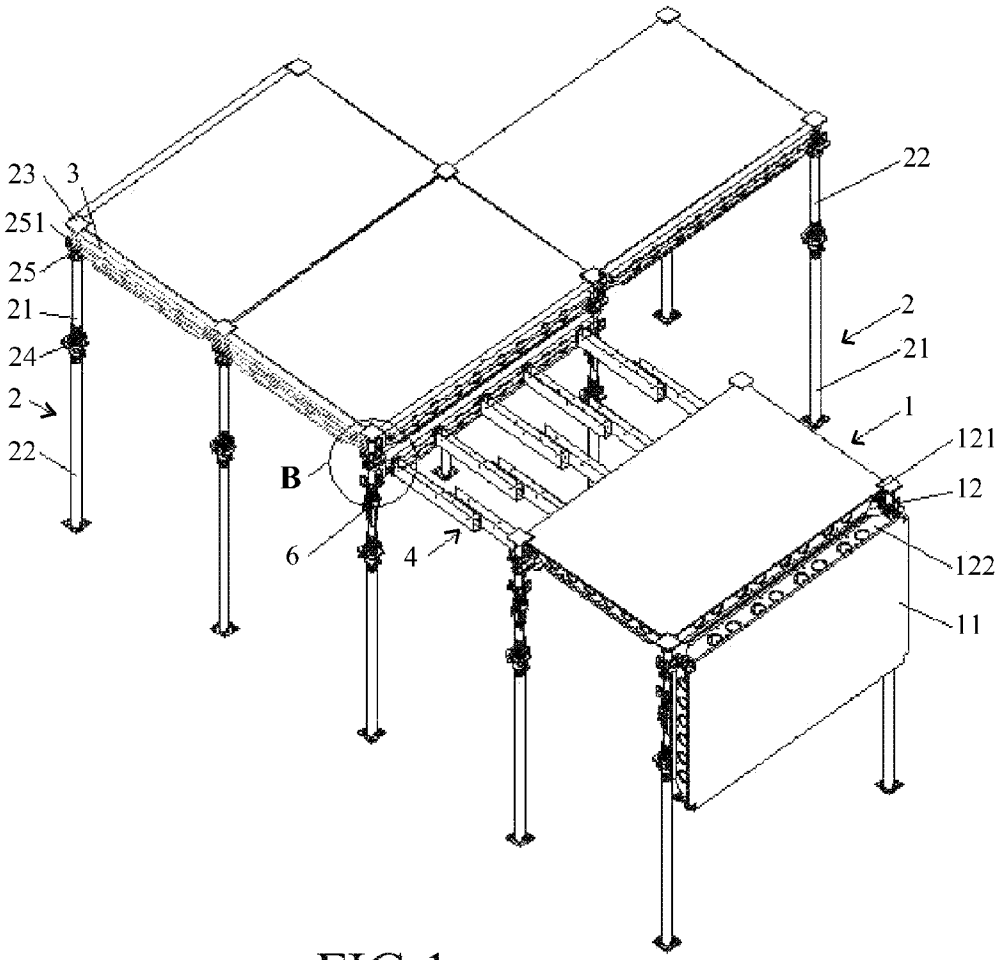
FIG. 1 is a structural schematic isometric view of the invention.
Figure 2:
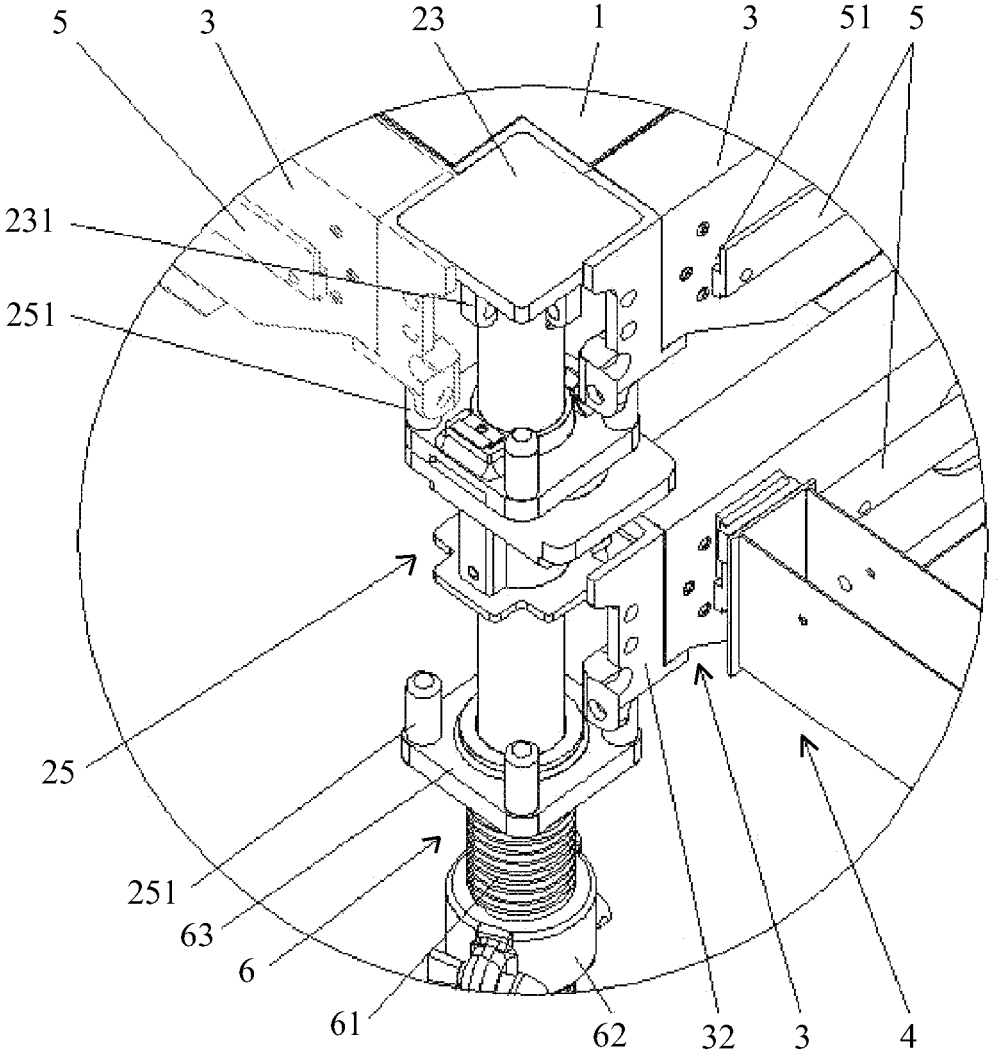
FIG. 2 is an enlarged view of the part A in FIG. 1 of the invention.

Referring to FIGS. 1 and 2, an early-stripping formwork system for concreting of constructions comprising beams, slab and columns comprises several standard formworks 1, props with multiple early-stripping support mechanisms 2, several filler beams 3 mainly used for supporting construction beams of floors, and filler panels the standard formwork 1 consists of a panel 11 and a formwork frame 12 and is in right-angle quadrilateral shape, and the formwork frame 12 of the standard formwork 1 is provided with L-shaped corners 121 at its four corners; the early-stripping prop 2 consists of an upper support inner tube 21 and a lower support outer tube 22 which form a telescopic connection, a rectangular head plate 23 is disposed at the top end of the upper support inner tube 21, and one corner of the head plate 23 is complementary to an internal corner of any one of the L-shaped corners 121 on the formwork frame 12. A load-releasing mechanism 24 which causes the upper support inner tube 21 to descend by a predetermined height is connected between the upper support inner tube 21 and the lower support outer tube 22. An early stripping mechanism 25 for early stripping of the standard formwork 1 is disposed on the upper support inner tube 21, short posts 251 for supporting the formwork frame 12 are disposed at four corners of the early stripping mechanism 25, and a structure for preventing the formwork frame 12 from slipping outwards is formed between the short post 251 and the L-shaped corner 121. The formwork frame 12 is in a detachable combined structure.

Figure 3:
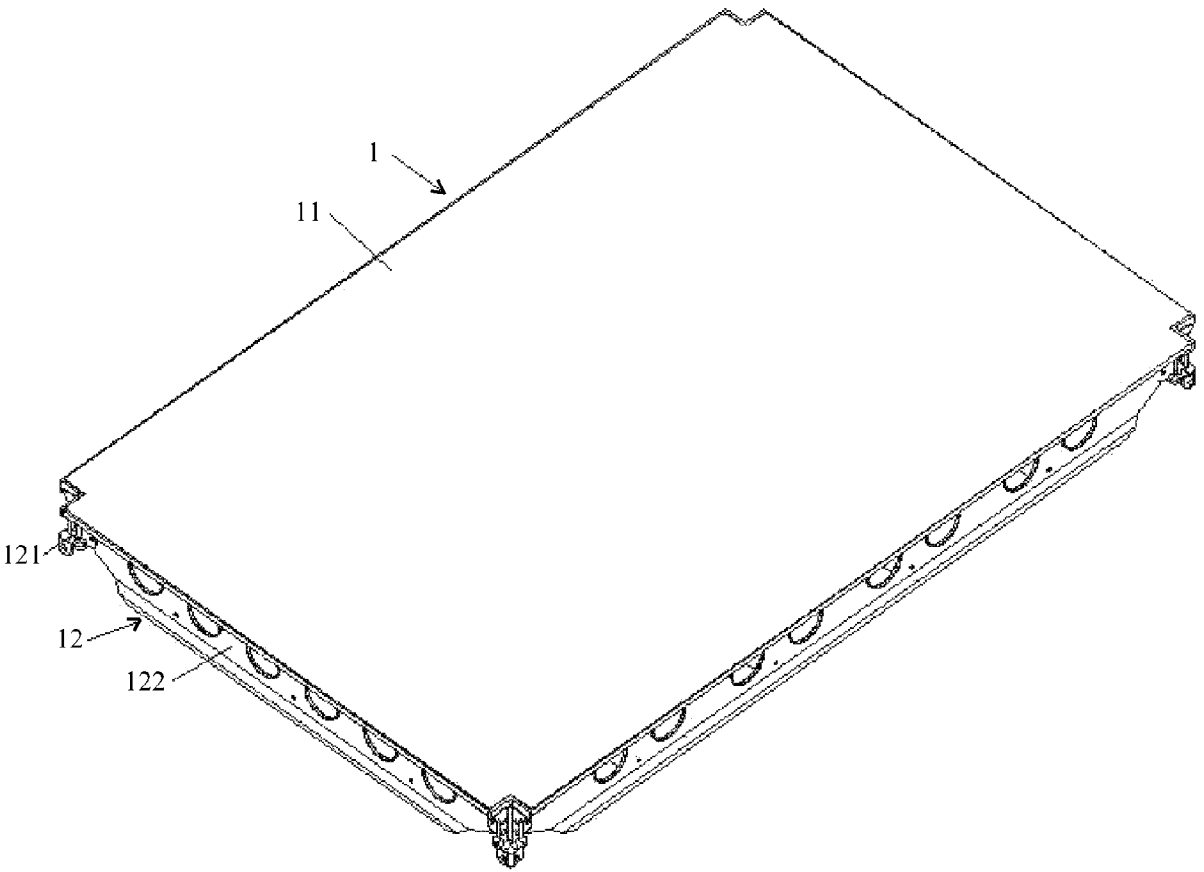
FIG. 3 is a structural schematic isometric view of the standard formwork of the invention.
Figure 4:
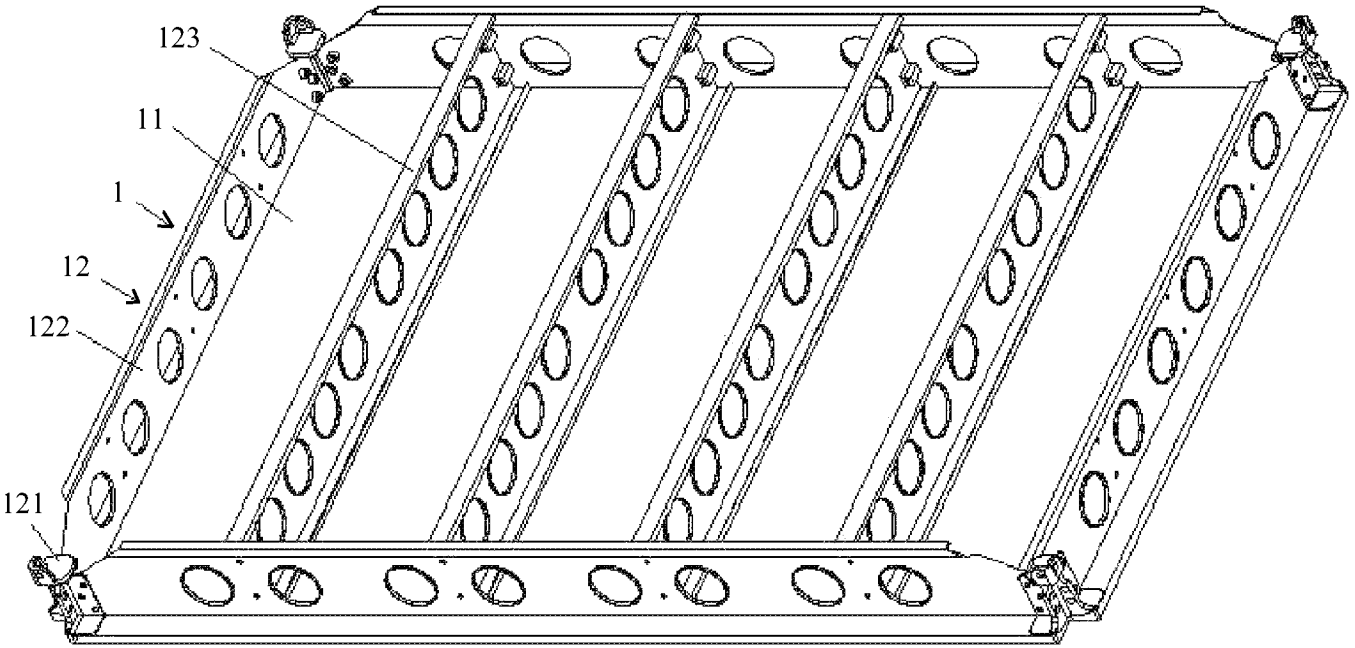
FIG. 4 is a structural schematic isometric view of the standard formwork in another direction of the invention.
Figure 5:
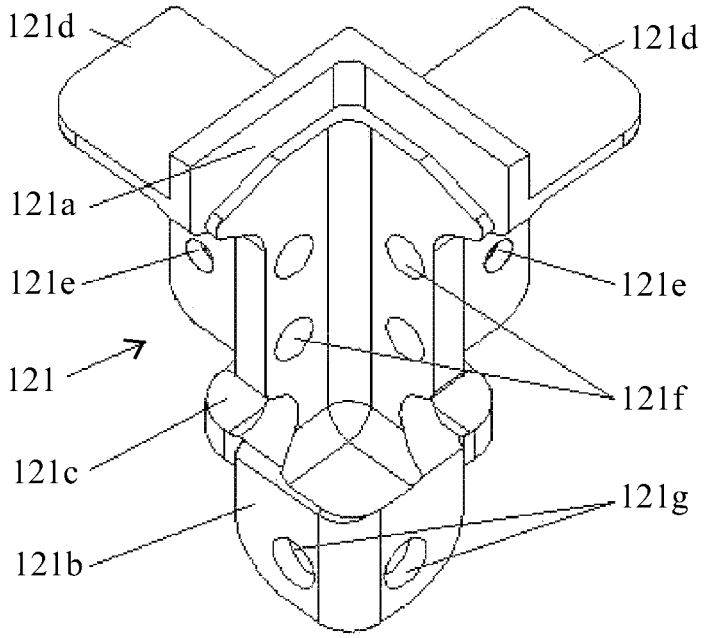
FIG. 5 is a structural schematic isometric view of the L-shaped corners of the invention.
Figure 6:
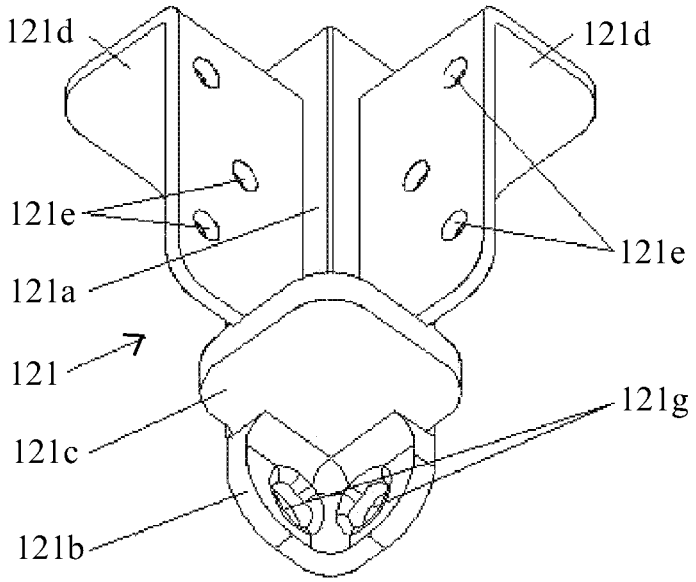
FIG. 6 is a structural schematic isometric view of the L-shaped corners in another direction of the invention.
Figure 7:
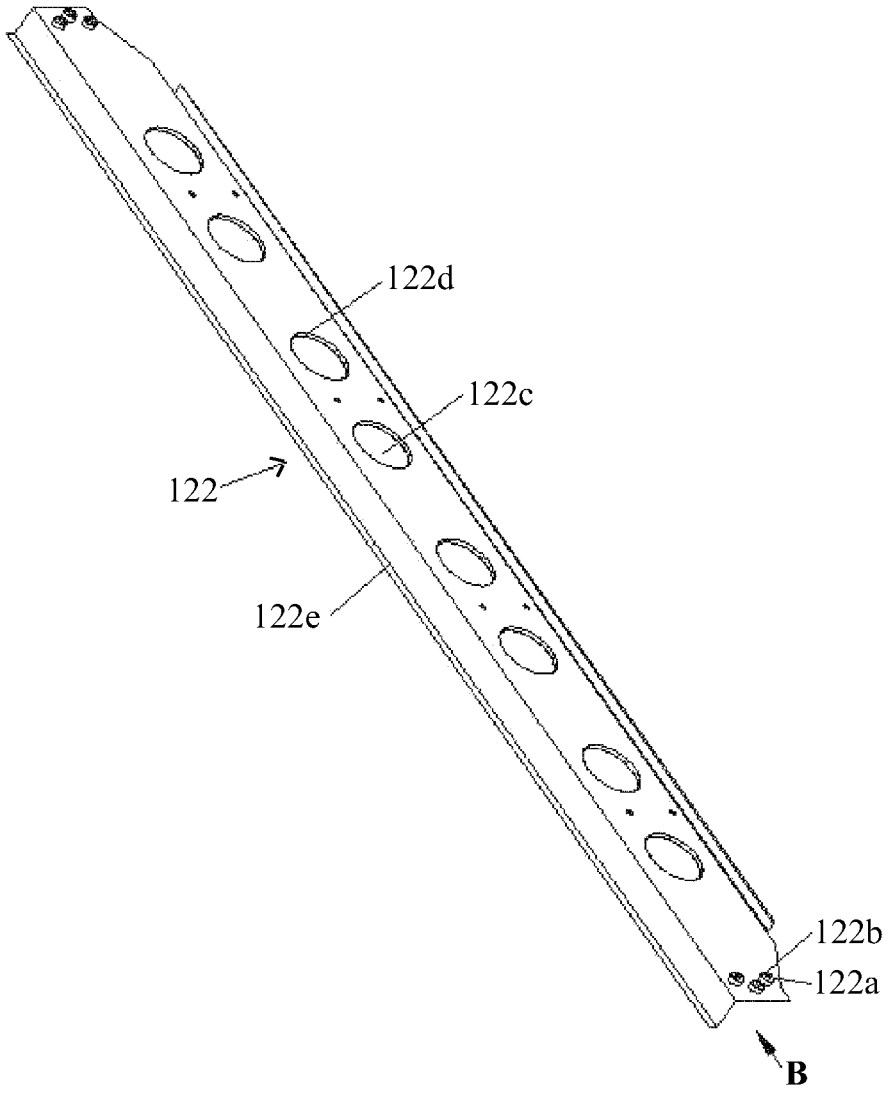
FIG. 7 is a structural schematic isometric view of frame border beams of the invention.
Figure 8:
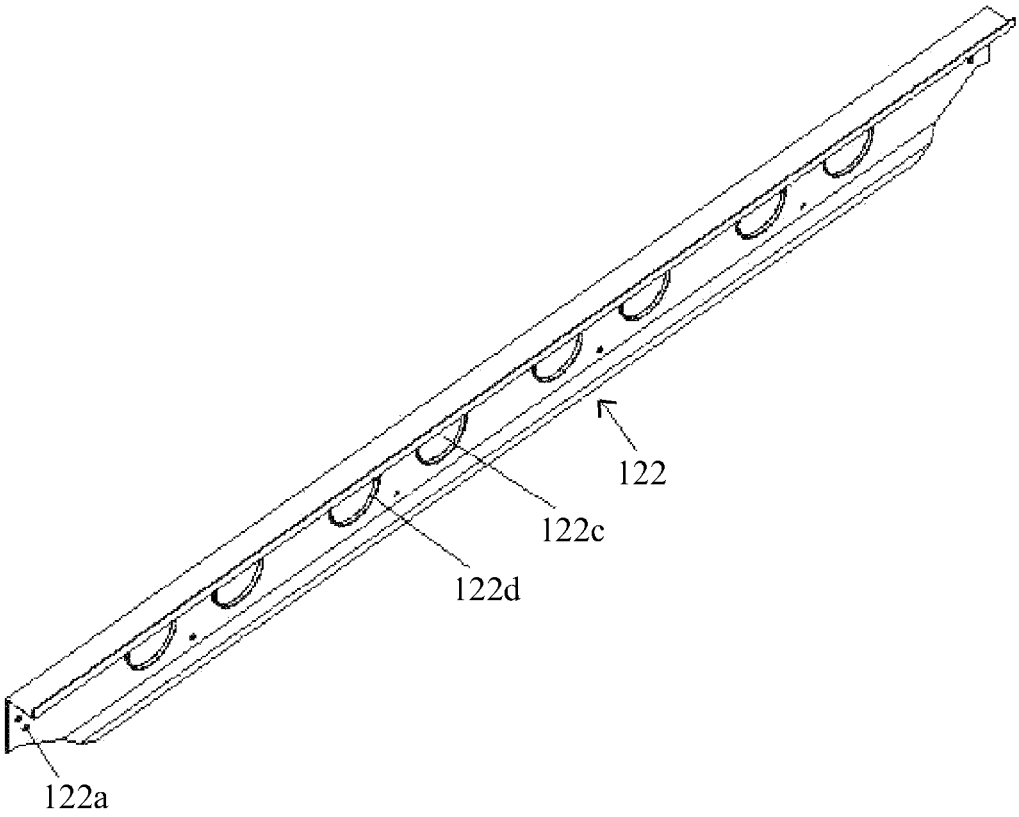
FIG. 8 is a structural schematic isometric view of frame border beams in another direction of the invention.
Figure 9:
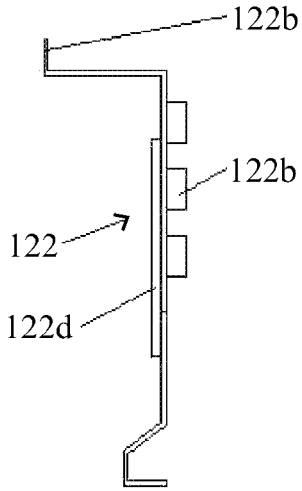
FIG. 9 is a view in the direction of B in FIG. 7 of the invention.
Figure 10:
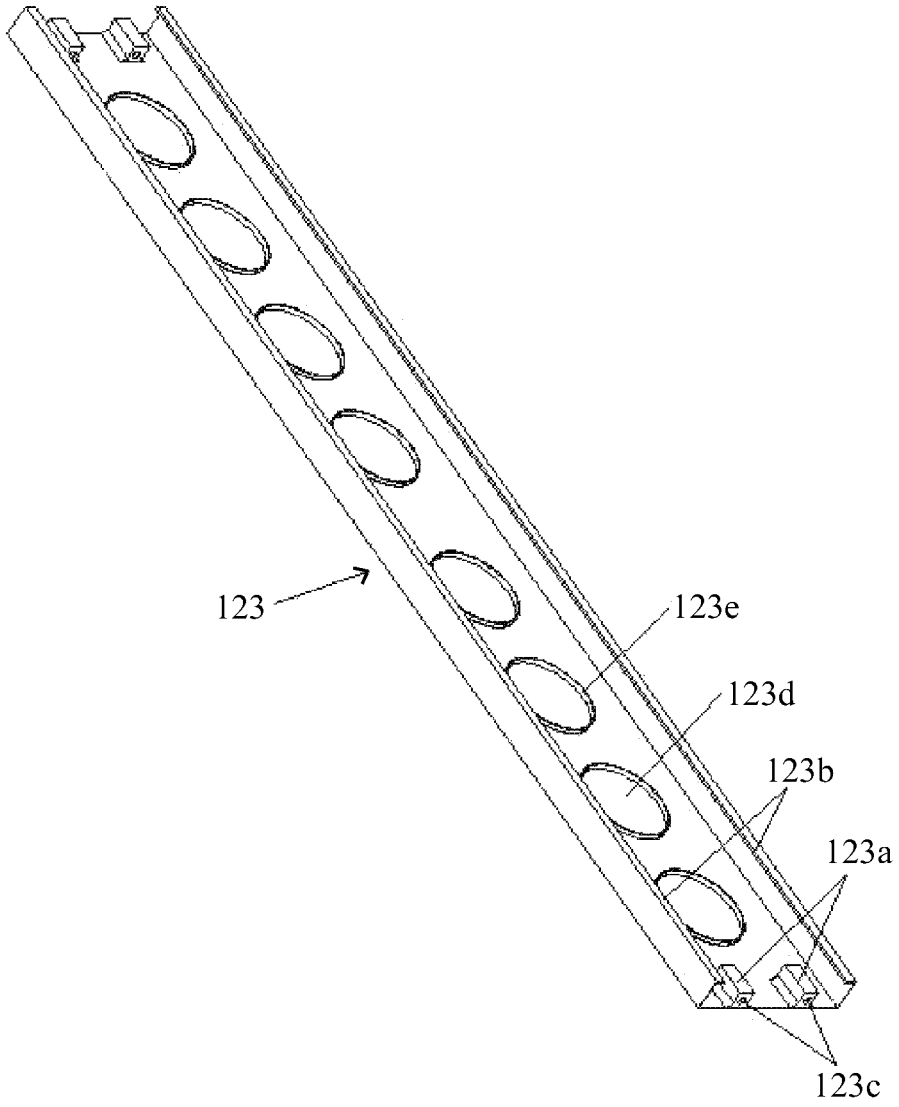
FIG. 10 is a structural schematic isometric view of stiffening beams of the invention.

Referring to FIGS. 3 and 4, the L-shaped corners 121 of the formwork frame 12 are fixedly connected with frame border beams 122 by bolts, the four frame border beams 122 form the rim of the formwork frame 12, a plurality of stiffening beams 123 are disposed between a set of two opposing frame border beams 122 therein, and the stiffening beams 123 are fixedly connected to the frame boarder beams 122 by bolts at both ends thereof; the L-shaped corners 121, the frame border beams 122 and the stiffening beams 123 each have a plane for supporting the panel 11.

The L-shaped corner 121 is in an integral structure; the frame border beam 122 is formed by bending of a sheet material, the main structure of the frame border beam 122 is in the shape of an inequilateral angle iron, the length of a vertical side of the angle iron of the frame border beam 122 is larger than that of a horizontal side thereof, the frame border beam 122 is connected to the L-shaped corner 121 by the vertical side thereof, and stiffening structures are fixedly connected at connection locations on the frame border beam 122 where the frame border beam 122 is connected with the L-shaped corner 121; the stiffening beam 123 is formed by bending of a sheet material, the main structure of the stiffening beam 123 is in the shape of a channel steel, the channel opening of the stiffening beam 123 is provided in horizontal direction, connection blocks 123*a* are fixedly connected at both ends of the stiffening beam 123, and the stiffening beam 123 is connected to the frame border beam 122 by the connection blocks 123*a*; the frame border beam 122 and the stiffening beam 123 are all provided with lightening holes for lightening weight thereof.

Referring to FIGS. 2, 5, 6, 7, 8, 9 and 10, the L-shaped corners 121 each comprises a top angle iron 121*a* and a bottom angle iron 121*b* which are provided vertically and are in opposite internal angle directions. The top angle iron 121*a* and the bottom angle iron 121*b* are connected by a support plate 121*c* which is provided horizontally and is supportable on an upper end face of any one of the short posts 251 of the early-stripping mechanism 25, and the bottom angle iron 121*b* and the short post 251 form a structure for preventing the formwork frame 12 from slipping outwards; support angle irons 121*d* extend horizontally on two angle iron sides of the top angle iron 121*a*, a horizontal side of the support angle iron 121*d* is located at an upper part of the top angle iron 121*a*, an upper plane of the horizontal side of the support angle iron 121*d* is used for supporting the panel 11 of the standard formwork 1, the distance between the upper plane of the horizontal side of the support angel steel 121*d* and an upper end face of the top angle iron 121*a* is equal to the thickness of the panel 11, and a vertical side of the support angle iron 121*d* is provided with frame border beams connection holes 121*e* for connecting the support angle iron with the frame border beams 122; the two angle iron sides of the top angle iron 121*a* provided with head plate connection holes 121*f* for connecting the top angle iron with the head plate 23; auxiliary support holes 121*g* are provided on the two angle iron sides of the bottom angle iron 121*b* and are used as temporal supports which support the standard formwork 1 on the short posts 251 of the early stripping mechanism 25 in early stripping or installation of the standard formwork 1; the standard formwork 1 can also be fixedly connected via bolts through the support holes 121*g*, to enhance overall rigidity of the formwork; four uniformly distributed engaging lugs 231 further project downwards on a lower end face of the head plate 23, and the engaging lugs 231 are provided with through holes that fit head plate connection holes 121*f* on any one of the angle iron sides of the top angle iron 121*a*; the stiffening structure of the frame border beam 122 is protruding pads 122*b* which are welded with the frame border beam 122, the frame border beam 122 is provided with connection through holes 122*a* through which the frame border beam 122 is in fixed connection with the L-shaped corner 121 by bolts, and the connection through holes 122*a* penetrate through the protruding pads 122*b*; a lower end of the vertical side of the angle iron of the frame border beam 122 is bent towards the direction of the internal angle of the inequilateral angle iron thereof to form channel steel shaped stiffening structure, and the lightening holes provided on the frame border beam 122 are a plurality of frame border beam lightening holes 122*c* positioned in the middle part of the vertical side of the angle iron; the upper end face of the horizontal side of the angle iron of the frame border beam 122 is used for supporting the panel 11 of the standard formwork 1, a turnup 122*e* for positioning the panel 11 extends upwards from the outer edge of the horizontal side of the angle iron of the frame border beam 122, the distance from an upper end face of the turnup 122*e* to the upper end face of the horizontal side of the angle iron of the frame border beam 122 is equal to the thickness of the panel 11; an outer end face of a side plate of the channel shape of the stiffening beam 123 is used for supporting the panel 11, two connection blocks 123*a* are provided at each end of the stiffening beams 123, are fixedly connected by welding respectively, and are provided with threaded holes 123*c* through which the stiffening beam 123 is fixedly connected to the corresponding frame border beam 122 by bolts; the lightening holes provided on the stiffening beams 123 are a plurality of weight lightening holes 123*d* that are positioned on a base plate of the channel shape thereof.

The connection through holes 122*a* of the frame border beam 122 are threaded holes, and a stiffening ring 122*d* is formed integrally by punching at the periphery of the frame border beam lightening holes 122*c* on the frame border beam 122; turnups 123*b* are provided at the tips of the two side plates of the channel shape of the stiffening beams 123, the tips of the two turnups 123*b* are provided in opposite directions, stiffening rings 123*e* protrude integrally at the periphery of the weight lightening holes 123*d* of the stiffening beam 123, and the stiffening rings 123*e* are located within the channel shape of the stiffening beam 123.

Figure 11:
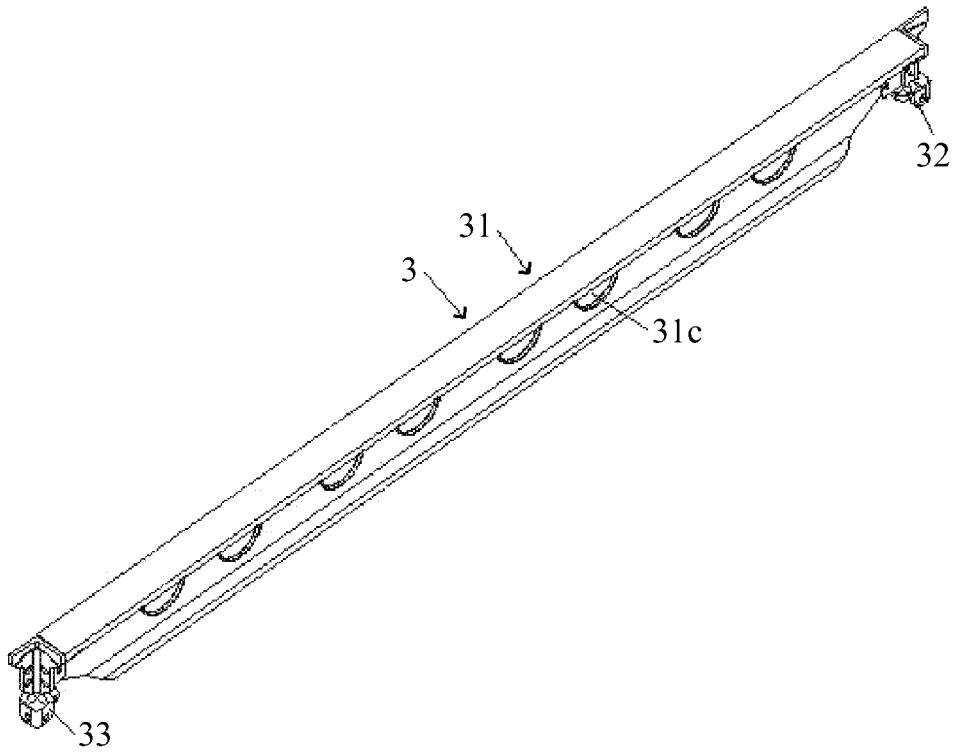
FIG. 11 is a structural schematic isometric view of filler beams of the invention.
Figure 12:
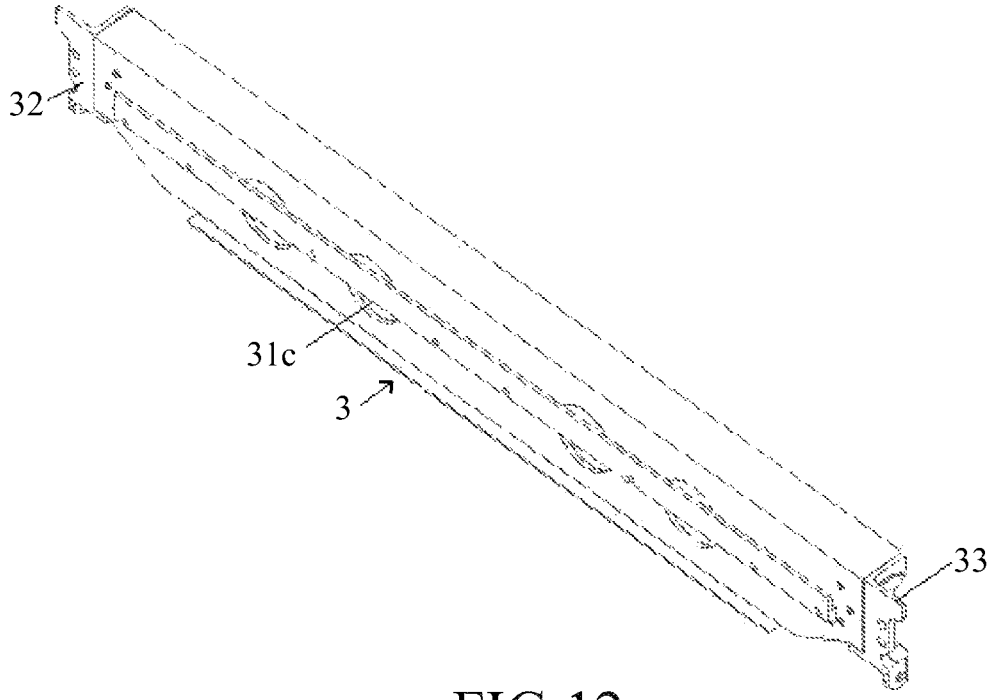
FIG. 12 is a structural schematic isometric view of filler beams in another direction of the invention.
Figure 13:
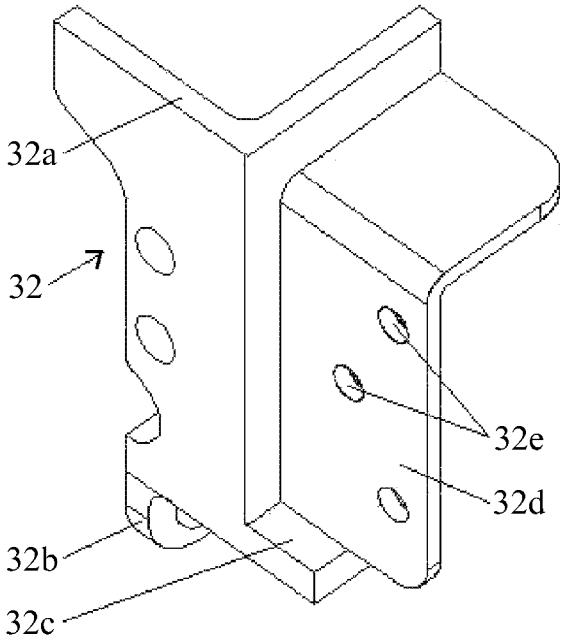
FIG. 13 is a structural schematic isometric view of the left corners of the invention.
Figure 14:
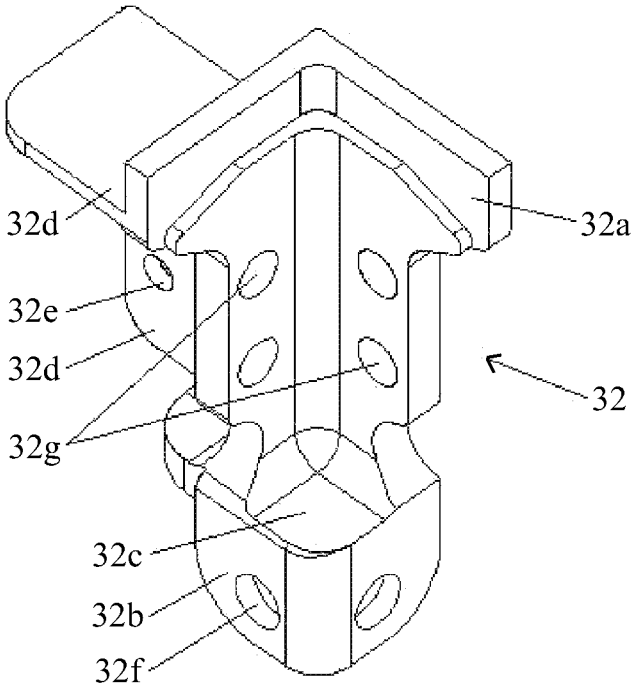
FIG. 14 is a structural schematic isometric view of the left corners in another direction of the invention.
Figure 15:
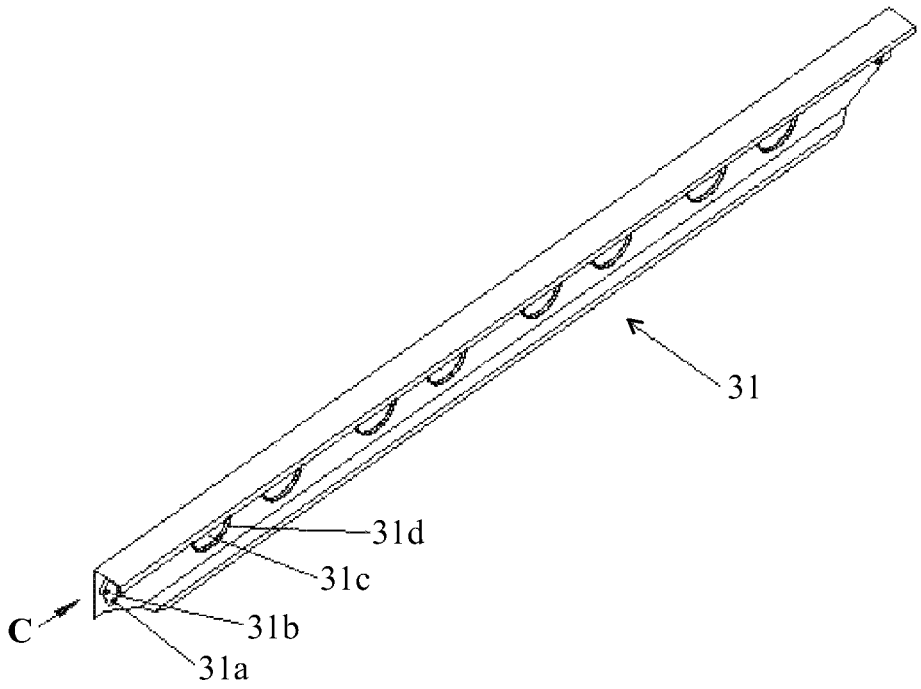
FIG. 15 is a structural schematic isometric view of a filler beam body of the invention.
Figure 16:
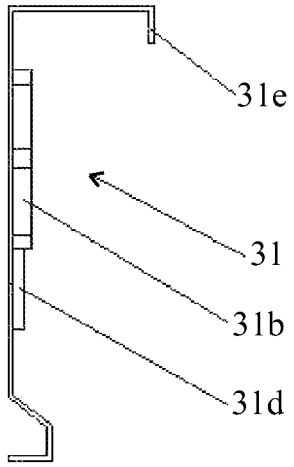
FIG. 16 is a view in the direction of C in FIG. 14 of the invention.

Referring to FIGS. 11 and 12, the filler beam 3 consists of a filler beam body 31, a left corner 32 and a right corner 33, wherein the left corner 32 and the right corner 33 are fixedly connected at both ends of the filler beam body 31 respectively by bolts and are in left-and-right symmetrical structure, the filler beams 3 can be supported on the corresponding short posts 251 of the corresponding early stripping mechanisms 25 respectively by the left corner 32 and the right corner 33, and a structure for preventing the filler beams 3 from slipping outwards is formed respectively between the short posts 251 and the left corner 32 and between the short posts 251 and the right corner 33; an upper plane of the filler beam body 31 and an upper plane of the head plate 23 are in one identical horizontal plane; both of the left corner 32 and the right corner 33 are provided with a corner structure including internal corners, and the internal corners of the left corner 32 and the right corner 33 are complementary to a corresponding corner of the head plate 23.

Each of the left corner 32 and the right corner 33 is in integral structure; the filler beam body 31 is formed by bending of a sheet material, the main structure of the filler beam body 31 is in the shape of an inequilateral angle iron, the length of a vertical side of the angle iron of the filler beam body 31 is larger than that of a horizontal side thereof, a stiffening backing plate 31*b* is welded at connection locations of the filler beam body 31 where the left corner 32 and the right corner 33 are connected with the filler beam body 31, connection via holes 31*a* are provided on the connection locations of the filler beam body 31 and penetrate through the stiffening backing plate 31*b*, and several lightening holes 31*c* for lightening the weight of the filler beam body 31 are provided at the middle part of the vertical side of the inequilateral angle iron of the filler beam body 31.

Referring to FIGS. 13, 14, 15 and 16, the left corner 32 comprises an upper angle iron 32*a* and a lower angle iron 32*b* which are provided vertically and are in opposite internal angle directions. The upper angle iron 32*a* and the lower angle iron 32*b* are connected by a connection plate 32*c* which is provided horizontally and is supportable on an upper end face of one of the short posts 251 of the early-stripping mechanism 25, and the lower angle iron 32*b* and the short post 251 form a structure for preventing the filler beams 3 from slipping outwards; two angle iron sides of the upper angle iron 32*a* are respectively provided with two punch holes 32*g* through one of which and bolts the standard formwork 1 and the filler beams 3 located near the standard formwork 1 can be fixedly connected to the head plate 23; a connection angle iron 32*d* in horizontal shape protrudes out on one angle iron side of the upper angle iron 32*a*, a horizontal side of the connection angle iron 32*d* is located at an upper part of the upper angle iron 32*a*, an upper plane of the horizontal side of the connection angle iron 32*d* is used for supporting the filler beam body 31, and a vertical side of the connection angle iron 32*d* is provided with filler beam body connection holes 32*e* for connecting the connection angle iron 32*d* with the filler beam body 31; the connection plate 32*c* also extends towards the direction of the filler beam body 31 and is used for supporting corresponding ends of the filler beam body 31; temporary support holes 32*f* are provided on two angle iron sides of the lower angle iron 32*b* and are used as temporal supports which support the filler beam 3 on the short posts 251 of the early stripping mechanism 25 in detaching or installation of the filler beam 3; the filler beam body 31 is fixedly connected to the left corner 32 and the right corner 33 by connection via holes 31*a* provided at both ends of the vertical side of the inequilateral angle iron thereof, the lower end of the vertical side of the inequilateral angle iron of the filler beam body 31 is further bent inwards to form a channel steel shaped stiffening structure having a trapezoidal cross section, the upper end face of the horizontal side of the inequilateral angle iron of the filler beam body 31 and the upper end faces of the upper angle irons 32*a* of the left corner 32 and the right corner 33 are in one identical horizontal plane, a turnup 31*e* going downwards is provided at a tip of the horizontal side of the inequilateral angle iron of the filler beam body 31, and connection angle irons 32*d* on the left corner 32 and the right corner 33 are wrapped within the turnup 31*e* on the horizontal side of the filler beam body 31.

The connection via holes 31*a* of the filler beam body 31 are threaded holes, and the lightening holes 31*c* of the filler beam body 31 integrally form a stiffening ring 31*d* along with the lightening holes at one side of the filler beam body.

Referring to FIG. 1, the filler panel consists of two filler beams 3 that are parallel and provided in opposite directions, a bridge beam 4 and a filler panel, the two filler beams 3 are fixedly connected by a screw and nuts through punch holes 32*g* that are provided on the lower angle iron 32*b* for connecting the left corner 32 with the right corner 33 thereof; a hanging structure is provided between the filler beam 3 and the bridge beam 4, and the bridge beam 4 is hung on the filler beam 3 by the hanging structure; the filler panel is fixedly connected on the bridge beam 4.

Referring to FIGS. 2 and 12, the hanging structure comprises a Z-shaped hanging strip 5 which is fixed at the outside of the vertical side of the inequilateral angle iron of the filler beam body 31 by riveting by means of one side of the hanging strip, and the other side of the Z-shape of the hanging strip 5 and the vertical side of the inequilateral angle iron of the filler beam body 31 form a hanging slot 51 opening upwards; "7"-shaped hangers 4*a* are welded and fixedly connected at both ends of the bridge beam 4, and the bridge beam 4 is hung on the two parallel filler beams 3 by the hangers 4*a* and the hanging slot 51.

Referring to FIG. 1, the main body of the bridge beam 4 is bent into channel steel shape using a sheet material, the channel opening of the bridge beam 4 faces upwards, and a wood is fixedly connected at the channel opening of the bridge beam 4 by bolts; the filler panel is fixedly connected to the wood by screws.

The bridge beam 4 consists of a first bridge beam 41 and a second bridge beam 42 which are provided in a lateral and staggered manner, slide guide rail pairs that fit with each other are provided on opposing side faces of the first bridge beam 41 and the second bridge beam 42, and the first bridge beam 41 and the second bridge beam 42 create the axial telescope of the bridge beam 4 by the slide guide rail pairs; the hangers 4*a* are provided respectively on distal end faces of the first bridge beam 41 and the second bridge beam 42; the length of the screw for the connection between the two filler beams 3 is adapted to the actual length of the bridge beam 4 after being telescoped.

Figure 17:
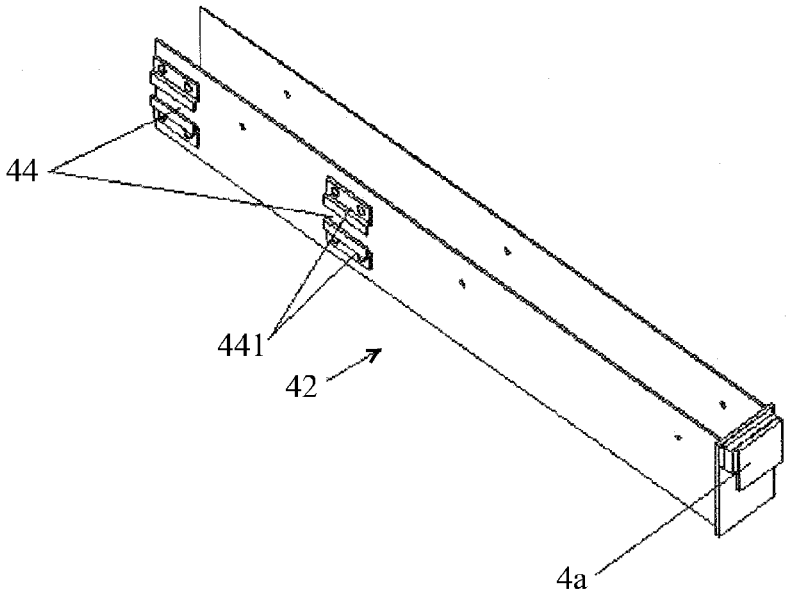
FIG. 17 is a structural schematic isometric view of the first bridge beam of the invention.
Figure 18:
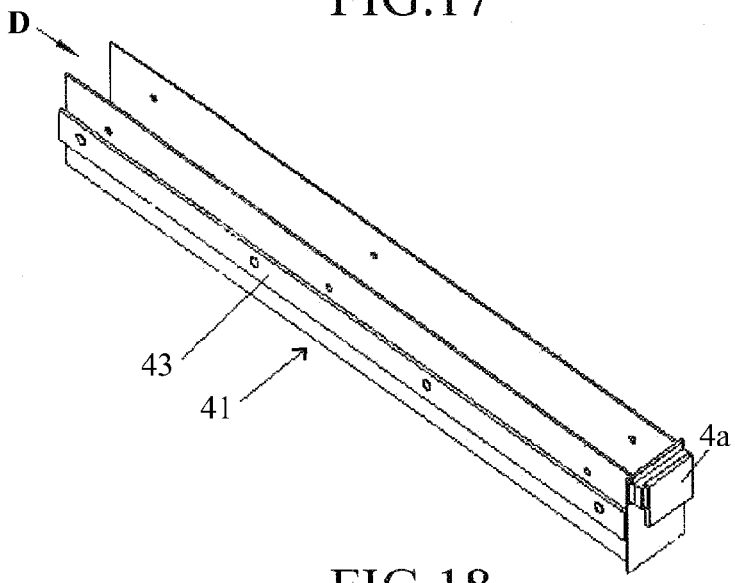
FIG. 18 is a structural schematic isometric view of the second bridge beam of the invention.
Figure 19:
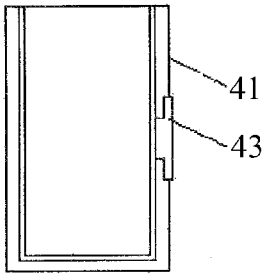
FIG. 19 is a view in the direction of D in FIG. 18 of the invention.
Figure 20:
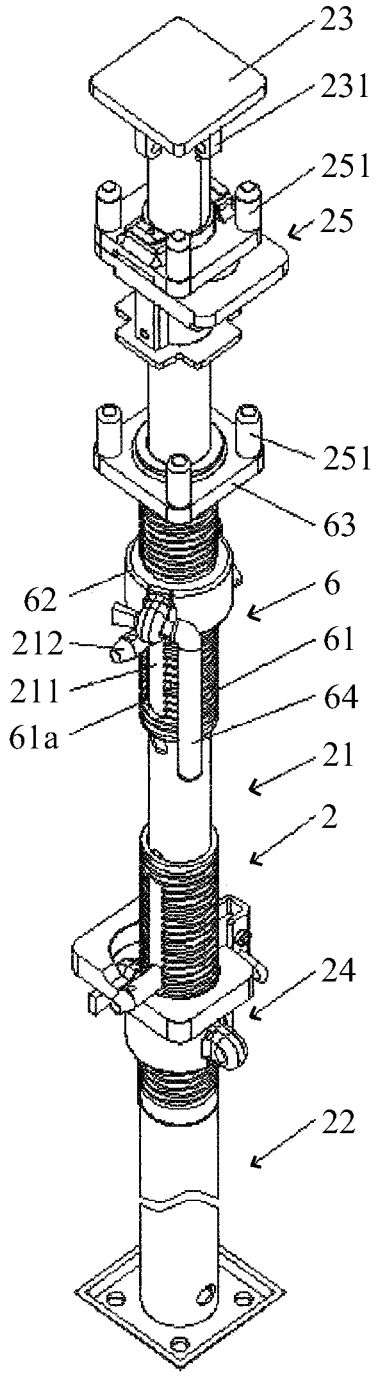
FIG. 20 is a structural schematic isometric view of the early stripping props provided with the second early stripping mechanisms of the invention.
Figure 21:
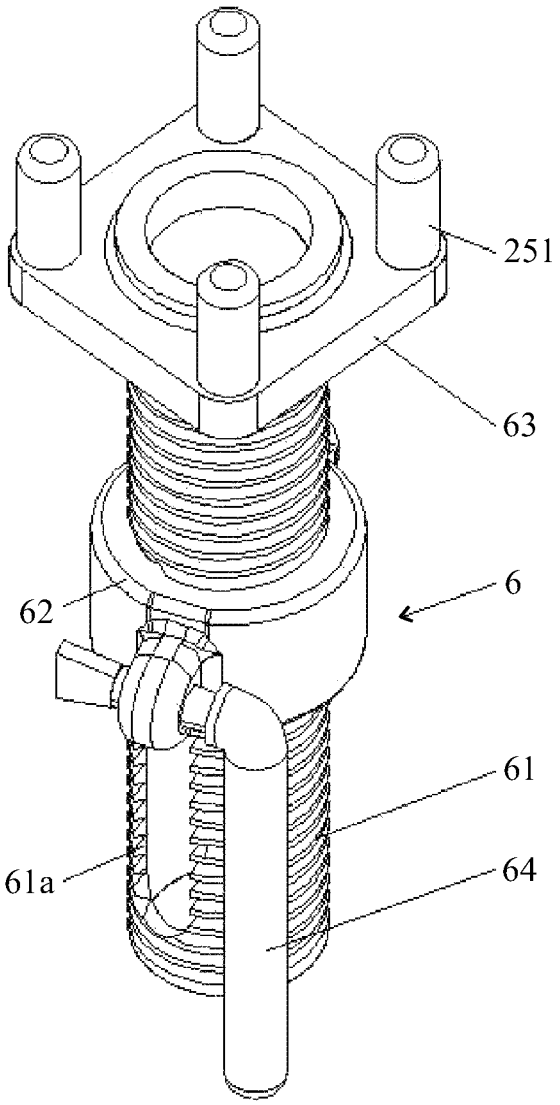
FIG. 21 is a structural schematic isometric view of the part of the second early stripping mechanism of the invention.

Referring to FIGS. 17, 18 and 19, the slide guide rail pair consists of a guide rail 43 and a sliding chute 44; the cross section of the guide rail 43 is T-shaped, the cross section of the sliding chute 44 fits with that of the guide rail 43, and the guide rail 43 is fixed on one side wall of the first bridge beam 41 by riveting; the sliding chute 44 is formed by two sets of two oppositely provided Z-shaped sectional materials 441 of which two form one set and a corresponding side wall of the second bridge beam 42, the Z-shaped sectional material 441 is fixed to the second bridge beam 42 by one side of the Z-shape thereof by riveting, and a space formed by the other sides of the two Z-shaped sectional materials and corresponding side walls form the sliding chute 44.

Referring to FIGS. 1, 2, 20 and 21, upper support inner tubes 21 of four adjacent early-stripping props 2 among the several early-stripping props 2 are provided with second early stripping mechanisms 6 which are used for supporting the standard formworks 1 or the filler panel of floors in slab bottom with steps, the second early stripping mechanisms 6 are provided with four short posts 251 the same with that in the early stripping mechanism 25, the short posts 251 are used for top-holding the standard formwork 1 or the filler panel.

The second early stripping mechanism 6 comprises a threaded pipe 61 provided with external thread, the threaded pipe 61 is movably sleeved at the periphery of a pipe pole 211 provided on the upper support inner tube 21, and the threaded pipe 61 is provided with a kidney-shaped slot 61*a* throughout the wall of the pipe; the threaded pipe 61 is in fitting with a nut 62 by the thread, and a flange 63 is fixedly connected at an upper end of the threaded pipe 61; the short posts 251 are fixedly connected on the flange 63 in a manner of being uniformly distributed; a pin shaft 212 is laterally fixed on the pipe pole 211, both ends of the pin shaft 212 are in slide fitting in the kidney-shaped slot 61*a* of the threaded pipe 61, the pin shaft 212 supports the nut 62 by an upper generatrix thereof, and the nut 62 is configured with a wrench 64 thereon for wrenching the nut 62 to rotate.

The structures of the early stripping mechanism 25, the load-releasing mechanism 24, the rectangular head plate 23 and the early stripping prop 2 that does not include the second early stripping mechanism are in correspondingly the same structure with the early stripping mechanism, the load-releasing mechanism, the rectangular head plate and the early stripping prop that does not include the second early stripping mechanism in the patent publication CN101591973A respectively.

The erection and detaching methods in actual use of the invention are the same with basic contents of the patent publication CN101591973A. The invention differs from the patent publication CN101591973A in that the standard formwork 1, the filler panel and the like need to be assembled on site; when the early stripping is performed by using the second early stripping mechanism, it only needs to rotate the nut 62 to cause the flange 63 and the short posts 251 thereon to descend by a predetermined distance. It is certain that in floors transformation on the construction site, the standard formwork 1 does not need to be detached into parts and components, in order to give full play to the advantages of the standard formwork.

When the filler panel and the standard formwork 1 in this embodiment are located in one identical plane, the second early stripping mechanism 6 is not needed, and moreover, the standard formwork 1 and the two filler beams 3 that form the filler panel are provided in opposite directions can be fixedly connected with the head plate 23 via the screw and the nut by means of the head plate connection holes 121*f* provided on the bottom angle iron 121*b* of the L-shaped corner 121 and the punch holes 32*g* provided on the lower angle irons 32*b* of the left corner 32 and the right corner 33.

The guide rail 43 of this embodiment also can be fixedly connected on one side wall of the second bridge beam 42 by screws, and the Z-shaped sectional material 441 forming the slide chute is fixedly connected on the first bridge beam 41 by screws on one side of the Z-shape. This can be achieved if the requirements of the guide rail 43 and the slide chute 44 forming the slide guide rail pairs can be met respectively.

The welding connection in this embodiment can be replaced with the threaded connection or the riveting connection, and similarly, the riveting connection can be replaced with the threaded connection and the welding connection. However, the connection rigidity of the welding connection and the riveting connection is better than that of the threaded connection, and the threaded connection has the advantage of being capable of being assembled and disassembled repeatedly, which plays an irreplaceable role in the detachable structure.

Although the embodiment of the invention has been described in the above incorporating the accompanying drawings, those skilled in the art can still be aware that variations or amendments made within the scope of the appended claims should fall within the scope and intension of the invention.

What is claimed is:

1. An early-stripping formwork system for concreting of constructions comprising beams, slab and columns, comprising several standard formworks (1), props with multiple early-stripping support mechanisms (2), several filler beams (3) mainly used for supporting construction beams of floors, and filler panels, wherein the standard formwork (1) comprises a panel (11) and a formwork frame (12) and is in right-angle quadrilateral shape, and the formwork frame (12) of the standard formwork (1) is provided with L-shaped corners (121) at its four corners, wherein the early-stripping prop (2) comprises an upper support inner tube (21) and a lower support outer tube (22) which forms a telescopic connection, a rectangular head plate (23) is disposed at the top end of the upper support inner tube (21), and one corner of the head plate is complementary to an internal corner of any one of the L-shaped corners (121) on the formwork frame (12), a load-releasing mechanism (24) which causes the upper support inner tube (21) to descend by a predetermined height is connected between the upper support inner tube (21) and the lower support outer tube (22), an early stripping mechanism (25) for early stripping of the standard formwork (1) is disposed on the upper support inner tube (21), short posts (251) for supporting the formwork frame (12) are disposed at four corners of the early stripping mechanism (25), and a structure for preventing the formwork frame (12) from slipping outwards is formed between the short post (251) and the L-shaped corner (121), wherein the formwork frame (12) is in a detachable combined structure; and wherein the L-shaped corners (121) of the formwork frame (12) are fixedly connected with frame border beams (122) by bolts, the four frame border beams (122) form the rim of the formwork frame (12), a plurality of stiffening beams (123) are disposed between a set of two opposing frame border beams (122) therein, and the stiffening beams (123) are fixedly connected to the frame boarder beams (122) by bolts at both ends thereof; and that the L-shaped corners (121), the frame border beams (122) and the stiffening beams (123) each have a plane for supporting the panel (11);

wherein the L-shaped corner (121) is in an integral structure; that the frame border beam (122) is formed by bending of a sheet material, the main structure of the frame border beam (122) is in the shape of an inequilateral angle iron, the length of a vertical side of the angle iron of the frame border beam (122) is larger than that of a horizontal side thereof, the frame border beam (122) is connected to the L-shaped corner (121) by the vertical side thereof, and stiffening structures are fixedly connected at connection locations on the frame border beam (122) where the frame border beam is connected with the L-shaped corner (121); that the stiffening beam (123) is formed by bending of a sheet material, the main structure of the stiffening beam (123) is in the shape of a channel steel, the channel opening of the stiffening beam (123) is provided in horizontal direction, connection blocks (123*a*) are fixedly connected at both ends of the stiffening beam (123), and the stiffening beam (123) is connected to the frame border beam (122) by the connection blocks (123*a*); and that the frame border beam (122) and the stiffening beam (123) are all provided with lightening holes for lightening weight thereof; and wherein the L-shaped corner (121) comprises a top angle iron (121*a*) and a bottom angle iron (121*b*) which are provided vertically and are in opposite internal angle directions, the top angle iron (121*a*) and the bottom angle iron (121*b*) are connected by a support plate (121*c*) which is provided horizontally and is supportable on an upper end face of any one of the short posts (251) of the early-stripping mechanism (25), and the bottom angle iron (121*b*) and the short post (251) form a structure for preventing the formwork frame (12) from slipping outwards; that support angle irons (121*d*) extend horizontally on two angle iron sides of the top angle iron (121*a*), a horizontal side of the support angle iron (121*d*) is located at an upper part of the top angle iron (121*a*), an upper plane of the horizontal side of the support angle iron (121*d*) is used for supporting the panel (11) of the standard formwork (1), the distance between the upper plane of the horizontal side of the support angel steel (121*d*) and an upper end face of the top angle iron (121*a*) is equal to the thickness of the panel (11), and a vertical side of the support angle iron (121*d*) is provided with frame border beams connection holes (121*e*) for connecting the support angle iron with the frame border beams (122); that the two angle iron sides of the top angle iron (121*a*) are provided with head plate connection holes (121*f*) for connecting the top angle iron with the head plate (23), auxiliary support holes (121*g*) are provided on the two angle iron sides of the bottom angle iron (121*b*) and are used as temporal supports which support the standard formwork (1) on the short posts (251) of the early stripping mechanism (25) in early stripping or installation of the standard formwork; that four uniformly distributed engaging lugs (231) further project downwards on a lower end face of the head plate (23), and the engaging lugs (231) are provided with through holes that fit head plate connection holes (121*f*) on any one of the angle iron sides of the top angle iron (121*a*); that the stiffening structure of the frame border beam (122) is protruding pads (122*b*) which are welded with the frame border beam (122), the frame border beam (122) is provided with connection through holes (122*a*) through which the frame border beam (122) is in fixed connection with the L-shaped corner (121) by bolts, and the connection through holes (122*a*) penetrate through the protruding pads (122*b*); that a lower end of the vertical side of the angle iron of the frame border beam (122) is bent towards the direction of the internal angle of the inequilateral angle iron thereof to form channel steel shaped stiffening structure, and the lightening holes provided on the frame border beams (122) are a plurality of frame border beam lightening holes (122*c*) positioned in the middle part of the vertical side of the angle iron; that the upper end face of the horizontal side of the angle iron of the frame border beam (122) is used for supporting the panel (11) of the standard formwork (251), a turnup (122*e*) for positioning the panel (11) extends upwards from the outer edge of the horizontal side of the angle iron of the frame border beam (122), the distance from an upper end face of the turnup (122*e*) to the upper end face of the horizontal side of the angle iron of the frame border beam (122) is equal to the thickness of the panel (11); that an outer end face of a side plate of the channel shape of the stiffening beam (123) is used for supporting the panel (11), two connection blocks (123*a*) are provided at each end of the stiffening beams (123), are fixedly by welding respectively, and are provided with threaded holes (123*c*) through which the stiffening beam (123) is fixedly connected to the corresponding frame border beam (122) by bolts; and that the lightening holes provided on the stiffening beams (123) are a plurality of weight lightening holes (123*d*) that are positioned on a base plate of the channel shape thereof.

2. The early-stripping formwork system for concreting of constructions comprising beams, slab and columns according to claim 1, wherein the connection through holes (122*a*) of the frame border beam (122) are threaded holes, and a stiffening ring (122*d*) is formed integrally by punching at the periphery of the frame border beam lightening holes (122*c*) on the frame border beam (122); and that turnups (123*b*) are provided at the tips of the two side plates of the channel shape of the stiffening beams (123), the tips of the two turnups (123*b*) are provided in opposite directions, stiffening rings (123*e*) protrude integrally at the periphery of the weight lightening holes (123*d*) of the stiffening beam (123), and the stiffening rings (123*e*) are located within U-shaped part of the stiffening beam (123).

3. The early-stripping formwork system for concreting of constructions comprising beams, slab and columns according to claim 1, wherein the filler panel comprises two filler beams (3) that are parallel and are provided in opposite directions, a bridge beam (4), and a filler panel, wherein a hanging structure is provided between the filler beam (3) and the bridge beam (4), and the bridge beam (4) is hung on the filler beam by the hanging structure; and that the filler panel is fixedly connected on the bridge beam (4).

4. The early-stripping formwork system for concreting of constructions comprising beams, slab and columns according to claim 3, wherein the main body of the bridge beam (4) is bent into channel steel shape using a sheet material, the channel opening of the bridge beam (4) faces upwards, and a wood is fixedly connected at the channel opening of the bridge beam 4 by bolts; and that the filler panel is fixedly connected to the wood by screws.

5. The early-stripping formwork system for concreting of constructions comprising beams, slab and columns according to claim 3, wherein the bridge beam (4) comprises a first bridge beam (41) and a second bridge beam (42) which are provided in a lateral and staggered manner, slide guide rail pairs that fit with each other are provided on opposing side faces of the first bridge beam (41) and the second bridge beam (42), and the first bridge beam (41) and the second bridge beam (42) create the axial telescope of the bridge beam (4) by the slide guide rail pairs; and that the hangers (4*a*) are provided respectively on distal end faces of the first bridge beam (41) and the second bridge beam (42).

6. The early-stripping formwork system for concreting of constructions comprising beams, slab and columns according to claim 5, wherein the slide guide rail pair comprises a guide rail (43) and a sliding chute (44); that the cross section of the guide rail (43) is T-shaped, the cross section of the sliding chute (44) fits with that of the guide rail (43), and the guide rail (43) is fixedly connected on one side wall of the first bridge beam (41) or the second bridge beam (42); that the sliding chute (44) is formed by at least one set of two oppositely provided Z-shaped sectional materials (441) of which two form one set and a corresponding side wall of the second bridge beam (42) or the first bridge beam (41), the Z-shaped sectional material (441) is fixedly connected to the second bridge beam (42) or the first bridge beam (41) by one side of the Z-shape thereof, and a space formed by the other sides of the two Z-shaped sectional materials (441) and corresponding side walls forms the sliding chute (44).

7. The early-stripping formwork system for concreting of constructions comprising beams, slab and columns according to claim 1, wherein upper support inner tubes (21) of at least four adjacent early-stripping props (2) among the several early-stripping props (2) are provided with second early stripping mechanisms (6) which are used for supporting the standard formworks (1) or the filler panel of floors in slab bottom with steps, the second early stripping mechanisms (6) are provided with four short posts (251) the same with that in the early stripping mechanism (25), the short posts (251) are used for top-holding the standard formwork (1) or the filler panel.

8. The early-stripping formwork system for concreting of constructions comprising beams, slab and columns according to claim 7, wherein the second early stripping mechanism (6) comprises a threaded pipe (61) provided with external thread, the threaded pipe (61) is movably sleeved at the periphery of a pipe pole (211) provided on the upper support inner tube (21), and the threaded pipe (61) is provided with a kidney-shaped slot (61*a*) throughout the wall of the pipe; that the threaded pipe (61) is in fitting with a nut (62) by the thread, and a flange (63) is fixedly connected at an upper end of the threaded pipe (61); that the short posts (251) are fixedly connected on the flange (63) in a manner of being uniformly distributed; and that a pin shaft (212) is laterally fixed on the pipe pole (211), both ends of the hinge pin (212) are in slide fitting in the kidney-shaped slot (61*a*) of the threaded pipe (61), the hinge pin (212) supports the nut (62) by an upper generatrix thereof.

9. An early-stripping formwork system for concreting of constructions comprising beams, slab and columns, comprising several standard formworks (1), props with multiple early-stripping support mechanisms (2), several filler beams (3) mainly used for supporting construction beams of floors, and filler panels, wherein the standard formwork (1) comprises a panel (11) and a formwork frame (12) and is in right-angle quadrilateral shape, and the formwork frame (12) of the standard formwork (1) is provided with L-shaped corners (121) at its four corners, wherein the early-stripping prop (2) comprises an upper support inner tube (21) and a lower support outer tube (22) which forms a telescopic connection, a rectangular head plate (23) is disposed at the top end of the upper support inner tube (21), and one corner of the head plate is complementary to an internal corner of any one of the L-shaped corners (121) on the formwork frame (12), a load-releasing mechanism (24) which causes the upper support inner tube (21) to descend by a predetermined height is connected between the upper support inner tube (21) and the lower support outer tube (22), an early stripping mechanism (25) for early stripping of the standard formwork (1) is disposed on the upper support inner tube (21), short posts (251) for supporting the formwork frame (12) are disposed at four corners of the early stripping mechanism (25), and a structure for preventing the formwork frame (12) from slipping outwards is formed between the short post (251) and the L-shaped corner (121), wherein the formwork frame (12) is in a detachable combined structure, wherein the filler beam (3) comprises a filler beam body (31), a left corner (32) and a right corner (33), wherein the left corner (32) and the right corner (33) are fixedly connected at both ends of the filler beam body (31) respectively by bolts and are in left-and-right symmetrical structure, the filler beams (3) can be supported on the corresponding short posts (251) of the corresponding early stripping mechanisms (25) respectively by the left corner (32) and the right corner (33), and a structure for preventing the filler beams (3) from slipping outwards is formed respectively between the short posts (251) and the left corner (32) and between the short posts (251) and the right corner (33); that an upper plane of the filler beam body (31) and an upper plane of the head plate (23) are in one identical horizontal plane; and that both of the left corner (32) and the right corner (33) are provided with a corner structure including internal corners, and the internal corners of the left corner (32) and the right corner (33) are complementary to a corresponding corner of the head plate (23).

10. The early-stripping formwork system for concreting of constructions comprising beams, slab and columns according to claim 9, wherein each of the left corner (32) and the right corner (33) is in integral structure; and that the filler beam body (31) is formed by bending of a sheet material, the main structure of the filler beam body (31) is in the shape of an inequilateral angle iron, the length of a vertical side of the angle iron of the filler beam body (31) is larger than that of a horizontal side thereof, a stiffening backing plate (31*b*) is welded at connection locations of the filler beam body (31) where the left corner (32) and the right corner (33) are connected with the right corner (33), connection via holes (31*a*) are provided on the connection locations of the filler beam body (31) and penetrate through the stiffening backing plate (31*b*), and several lightening holes (31*c*) for lightening the weight of the filler beam body (31) are provided at the middle part of the vertical side of the inequilateral angle iron of the filler beam body (31).

11. The early-stripping formwork system for concreting of constructions comprising beams, slab and columns according to claim 9, wherein the left corner (32) comprises an upper angle iron (32*a*) and a lower angle iron (32*b*) which are provided vertically and are in opposite internal angle directions, the upper angle iron (32*a*) and the lower angle iron (32*b*) are connected by a connection plate (32*c*) which is provided horizontally and is supportable on an upper end face of one of the short posts (251) of the early-stripping mechanism (25), and the lower angle iron (32*b*) and the short post (251) form a structure for preventing the filler beams (3) from slipping outwards; that two angle iron sides of the upper angle iron (32*a*) are respectively provided with at least one punch hole (32*g*) which can be selectively used in connection between the filler beam (3) and the standard formwork (1) and/or connection between the two filler beam (3) which are provided in opposite directions; that a connection angle iron (32*d*) in horizontal shape protrudes out on one angle iron side of the upper angle iron (32*a*), a horizontal side of the connection angle iron (32*d*) is located at an upper part of the upper angle iron (32*a*), an upper plane of the horizontal side of the connection angle iron (32*d*) is used for supporting the filler beam body (31), and a vertical side of the connection angle iron (32*d*) is provided with filler beam body connection holes (32*e*) for connecting the connection angle iron 32*d* with the filler beam body (31); that the connection plate (32*c*) also extends towards the direction of the filler beam body (31) and is used for supporting corresponding ends of the filler beam body (31); that temporary support holes (32*f*)are provided on two angle iron sides of the lower angle iron (32*b*) and are used as temporal supports which support the filler beam (3) on the short posts (251) of the early stripping mechanism (25) in detaching or installation of the filler beam 3; that the filler beam body (31) is fixedly connected to the left corner (32) and the right corner (33) by connection via holes (31*a*) provided at both ends of the vertical side of the inequilateral angle iron thereof, the lower end of the vertical side of the inequilateral angle iron of the filler beam body (31) is further bent inwards to form a channel steel shaped stiffening structure having a trapezoidal cross section, the upper end face of the horizontal side of the inequilateral angle iron of the filler beam body (31) and the upper end faces of the upper angle irons (32*a*) of the left corner (32) and the right corner (33) are in one identical horizontal plane, a turnup (31*e*) going downwards is provided at a tip of the horizontal side of the inequilateral angle iron of the filler beam body (31), and connection angle irons (32*d*) on the left corner (32) and the right corner (33) are wrapped within the turnup (31*e*) on the horizontal side of the filler beam body (31).

12. The early-stripping formwork system for concreting of constructions comprising beams, slab and columns according to claim 10, wherein the connection via holes (31*a*) of the filler beam body (31) are threaded holes, and a stiffening ring (31*d*) is integrally formed at one side of the filler beam body (31) along with the lightening holes (31*c*).

13. An early-stripping formwork system for concreting of constructions comprising beams, slab and columns, comprising several standard formworks (1), props with multiple early-stripping support mechanisms (2), several filler beams (3) mainly used for supporting construction beams of floors, and filler panels, wherein the standard formwork (1) comprises a panel (11) and a formwork frame (12) and is in right-angle quadrilateral shape, and the formwork frame (12) of the standard formwork (1) is provided with L-shaped corners (121) at its four corners, wherein the early-stripping prop (2) comprises an upper support inner tube (21) and a lower support outer tube (22) which forms a telescopic connection, a rectangular head late (23) is disposed at the top end of the upper support inner tube (21), and one corner of the head plate is complementary to an internal corner of any one of the L-shaped corners (121) on the formwork frame (12), a load-releasing mechanism (24) which causes the upper support inner tube (21) to descend by a predetermined height is connected between the upper support inner tube (21) and the lower support outer tube (22), an early stripping mechanism (25) for early stripping of the standard formwork (1) is disposed on the upper support inner tube (21), short posts (251) for supporting the formwork frame (12) are disposed at four corners of the early stripping mechanism (25), and a structure for preventing the formwork frame (12) from slipping outwards is formed between the short post (251) and the L-shaped corner (121), wherein the formwork frame (12) is in a detachable combined structure, wherein the filler panel comprises two filler beams (3) that are parallel and are provided in opposite directions, a bridge beam (4), and a filler panel, wherein a hanging structure is provided between the filler beam (3) and the bridge beam (4), and the bridge beam (4) is hung on the filler beam by the hanging structure; and that the filler panel is fixedly connected on the bridge beam (4), and wherein the hanging structure comprises a Z-shaped hanging strip (5) which is fixedly connected at the outer side of the vertical side of the inequilateral angle iron of the filler beam body (31) by means of one side of the hanging strip (5), and the other side of the Z-shape of the hanging strip (5) and the vertical side of the inequilateral angle iron of the filler beam body (31) form a hanging slot (51) with an opening facing upwards; and that "7"-shaped hangers (4*a*) are fixedly connected at both ends of the bridge beam (4), and the bridge beam (4) is hung on the two parallel filler beams (3) by the hangers (4*a*) and the hanging slot (51).

14. The early-stripping formwork system for concreting of constructions comprising beams, slab and columns according to claim 13, wherein the main body of the bridge beam (4) is bent into channel steel shape using a sheet material, the channel opening of the bridge beam (4) faces upwards, and a wood is fixedly connected at the channel opening of the bridge beam 4 by bolts; and that the filler panel is fixedly connected to the wood by screws.

15. The early-stripping formwork system for concreting of constructions comprising beams, slab and columns according to claim 13, wherein the bridge beam (4) comprises a first bridge beam (41) and a second bridge beam (42) which are provided in a lateral and staggered manner, slide guide rail pairs that fit with each other are provided on opposing side faces of the first bridge beam (41) and the second bridge beam (42), and the first bridge beam (41) and the second bridge beam (42) create the axial telescope of the bridge beam (4) by the slide guide rail pairs; and that the hangers (4*a*) are provided respectively on distal end faces of the first bridge beam (41) and the second bridge beam (42).

* * * * *